US008834197B2

(12) United States Patent
Wu et al.

(10) Patent No.: US 8,834,197 B2
(45) Date of Patent: Sep. 16, 2014

(54) CABLE ASSEMBLY HAVING SHIELDING PLATES BETWEEN CONDUCTIVE WIRES FOR CROSSTALK REDUCTION

(71) Applicants: Jerry Wu, Irvine, CA (US); Chien-Chiung Wang, New Taipei (TW); Jun Chen, Kunshan (CN); Fan-Bo Meng, Kunshan (CN)

(72) Inventors: Jerry Wu, Irvine, CA (US); Chien-Chiung Wang, New Taipei (TW); Jun Chen, Kunshan (CN); Fan-Bo Meng, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 60 days.

(21) Appl. No.: 13/738,512

(22) Filed: Jan. 10, 2013

(65) Prior Publication Data

US 2013/0178102 A1 Jul. 11, 2013

(30) Foreign Application Priority Data

Jan. 10, 2010 (CN) ..... 2012 2 0008380

(51) Int. Cl.
*H01R 13/24* (2006.01)

(52) U.S. Cl.
USPC ..... 439/497; 439/607.48; 439/607.49

(58) Field of Classification Search
USPC ..... 439/607.46–49, 497
IPC .... H01R 13/658,13/65802, 13/6658, 13/65807, H01R 9/0757, 23/662
See application file for complete search history.

(56) References Cited

U.S. PATENT DOCUMENTS

| | | | | |
|---|---|---|---|---|
| 7,059,914 | B2 * | 6/2006 | Tsai | 439/660 |
| 7,192,310 | B1 * | 3/2007 | Chao et al. | 439/607.45 |
| 7,267,575 | B1 | 9/2007 | Hwang | |
| 7,435,132 | B1 * | 10/2008 | Fong et al. | 439/497 |
| 8,011,941 | B2 | 9/2011 | Sadick et al. | |
| 8,556,648 | B2 * | 10/2013 | Wu | 439/367 |
| 2011/0306244 | A1 | 12/2011 | Zhang et al. | |

* cited by examiner

*Primary Examiner* — Hien Vu
(74) *Attorney, Agent, or Firm* — Ming Chieh Chang; Wei Te Chung

(57) ABSTRACT

A cable assembly comprises a metallic housing defining a receiving room and a number of protruding plates formed in the receiving room, and a printed circuit board received into the receiving room. The printed circuit board defines a front mating portion and a rear terminating portion defining a number of slits formed thereon for the protruding plates to pass through. And a cable comprises a plurality conductive wires electrically connected with the printed circuit board and spaced apart from each other by the protruding plates.

11 Claims, 5 Drawing Sheets

CABLE ASSEMBLY HAVING SHIELDING PLATES BETWEEN CONDUCTIVE WIRES FOR CROSSTALK REDUCTION

FIELD OF THE INVENTION

The present invention relates to a cable assembly, and more particularly to a cable assembly used for high-speed transmission.

DESCRIPTION OF PRIOR ART

SFP (Small Form-factor Pluggable), XFP, and QSFP are modules for fiber optic (light signal) transmission or electrical signal transmission. For example, U.S. Pat. No. 8,011,948 issued to Wu on Sep. 6, 2011 discloses a cable assembly with a copper cable or an optical cable. The cable assembly comprises a metallic housing, a printed circuit board disposed in the metallic housing, a pair of latches located at two sides of the metallic housing, and a gasket surrounding an outer surface of the metallic housing. The cable comprises a plurality of conductive wires respectively soldered to corresponding conductive pads on the printed circuit board. However, crosstalk problem may occur between adjacent conductive wires during signal transmission.

As discussed above, an improve cable assembly overcoming the shortages of existing technology is needed.

SUMMARY OF THE INVENTION

Accordingly, an object of the present invention is to provide a cable assembly with anti-crosstalk function to improve the signal transmitting quality.

In order to achieve the object set forth, a cable assembly in accordance with the present invention comprises: a metallic housing defining a receiving room and a plurality of plates in the receiving room; a printed circuit board received in the receiving room, the printed circuit board defining a front mating portion and a rear terminating portion, the rear terminating portion defining a plurality of slits for the plates to extend through; and a cable comprising a plurality conductive wires electrically connected with the rear terminating portion of the printed circuit board and spaced apart from each other by the plates.

Other objects, advantages and novel features of the invention will become more apparent from the filling detailed description when taken in conjunction with the accompanying drawing.

DETAILED DESCRIPTION OF PREFERRED EMBODIMENTS

Figure 1:
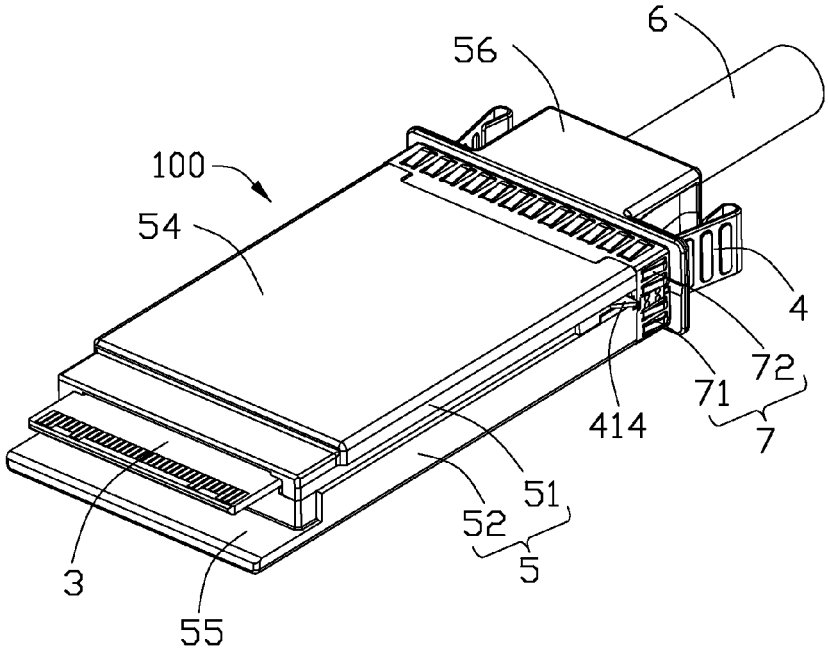
FIG. 1 is an assembled, perspective view of a cable assembly in accordance with the present invention.

Reference will now be made in detail to preferred embodiment of the present invention.

Referring to FIGS. 1-5, a cable assembly 100 in accordance with the present invention comprises a metallic housing 5, a printed circuit board 3 disposed in the metallic housing 5, a pair of latches 4 located at two sides of the metallic housing 5, a gasket 7 surrounding an out surface of the metallic housing 5, a cable 6 soldering to the printed circuit board 3, and a strain relief 9 attached to a front end of the cable 6.

Also shown in FIGS. 1-5, the metallic housing 5 comprises an upper cover 51 and a lower cover 52 assembled to the upper cover 51.

The lower cover 52 includes a first base portion 520, a first tongue portion 521 extending forwardly from the first base portion 520, and a first rear portion 523 extending rearwardly from the first base portion 520. The first base portion 520 defines a first recess 5201 extending downwardly from the top surface thereof for a distance and a pair of first channels 5204 located at two sides of the first recess 5201. The pair of first channels 5204 are respectively disposed at a rear and lateral of the first base portion 520 and spaced apart from the first recess 5201 in a widthwise direction. The two sides of the first base portion 520 each define a protruding portion 5205. The lower cover 52 defines a row of plates 5202 formed in the first recess 5201, preferably protruding therefrom, and arranged along a transversal direction and spaced apart from each other. The protruding plates 5202 are perpendicular to the bottom surface of the first recess 5201. The first base portion 520 also defines a first depressed area 5203 located at the rear end thereof and formed on the bottom and two lateral surfaces thereof. The first rear portion 523 defines a first semicircular slot 5232 for supporting the cable 6 and communicated with the first recess 5201. And a first groove 5231 is formed in the first semicircular slot 5232 for cooperating with a portion of the strain relief 9. The first rear portion 523 also defines an inclined slot 5230 depressed from the two lateral sides thereof. A plurality of receiving holes 5206 are respectively formed in the two sides of the lower cover 52.

The upper cover 51 includes a second base portion 510 and a second rear portion 513 extending rearwardly from the second base portion 510. The second base portion 510 defines a second recess 5101 extending upwardly from the bottom surface thereof for a distance and a pair of second channels 5104 located at two sides of the second recess 5101. The second recess 5101 is corresponding to the first recess 5201 in an up to down direction. The pair of second channels 5104 are respectively disposed at a rear end and two lateral sides of the first base portion 510 and spaced apart each other by the first recess 5101 in a widthwise direction. Two protruding pieces 5105 are respectively formed in the pair of second channels 5104. The pair of second channels 5104 are also corresponding to the pair of first channels 5204 of the lower cover 52 in an up to down direction. Each of the two sides of the second base portion 510 defines an opening portion 5102 corresponding to protruding portion 5205 of the lower cover 52 in an up to down direction. The second base portion 510 also defines a second depressed area 5103 located at the rear end thereof and formed on the bottom and two lateral surfaces thereof. The second rear portion 513 defines a second semicircular slot 5132 for supporting the cable 6 and is in communication with the second recess 5101 and corresponding to the first semicircular slot 5232 of the lower cover 52 along an up to down direction. And a second groove 5131 is formed in the second semicircular slot 5132 for cooperating with anther portion of the strain relief 9. The second rear portion 513 also defines an inclined slot 5130 depressed from the two lateral sides thereof. A plurality of through holes 5106 are formed in the two sides of the upper cover 51 corresponding to the receiving holes 5206 of the lower cover 52. The printed circuit board 3 can be received into a room formed by the first and second recess 5201, 5101. And the pair of latches 4 can be respectively disposed into a pair of receiving spaces formed by the pair of first and second channels 5204, 5104.

Figure 2:
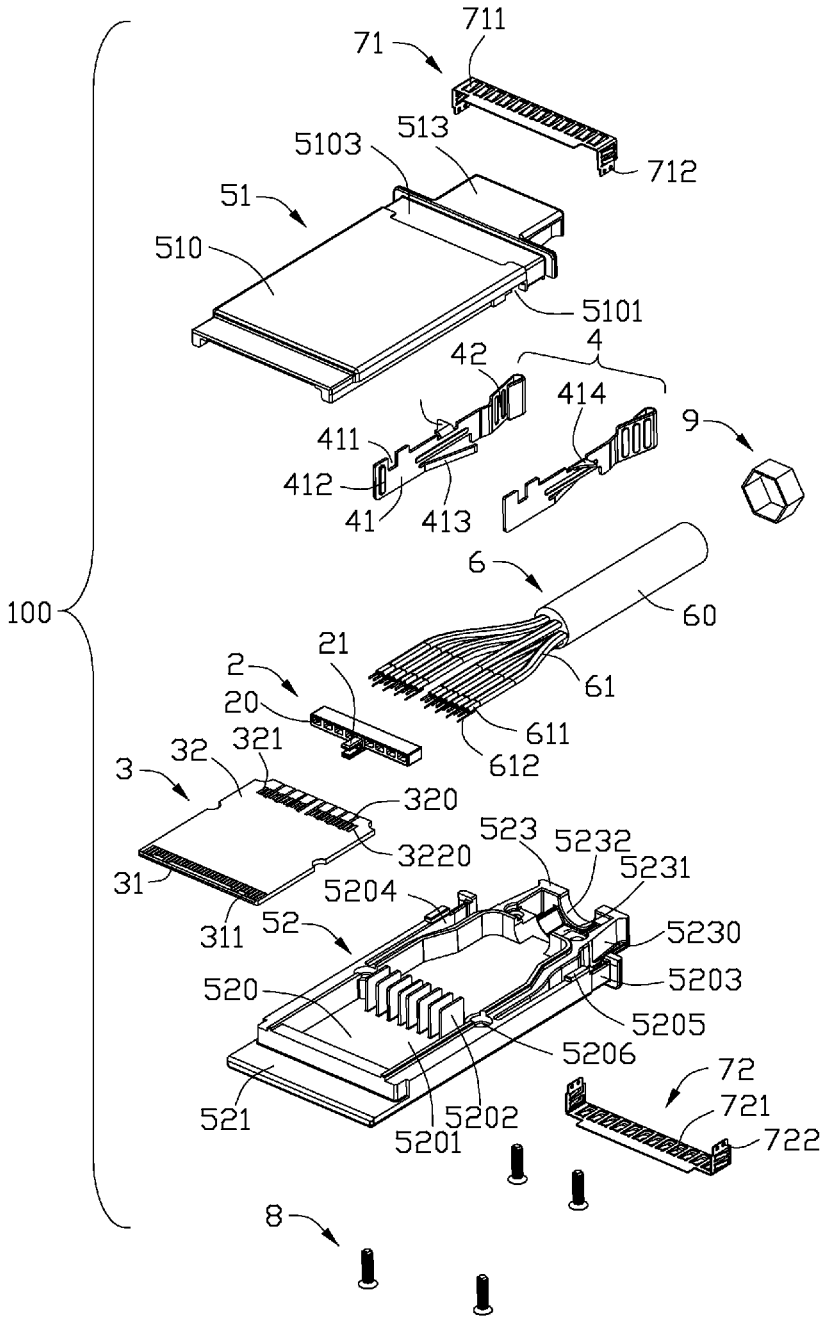
FIG. 2 is an exploded, perspective view of the cable assembly of FIG. 1.
Figure 3:
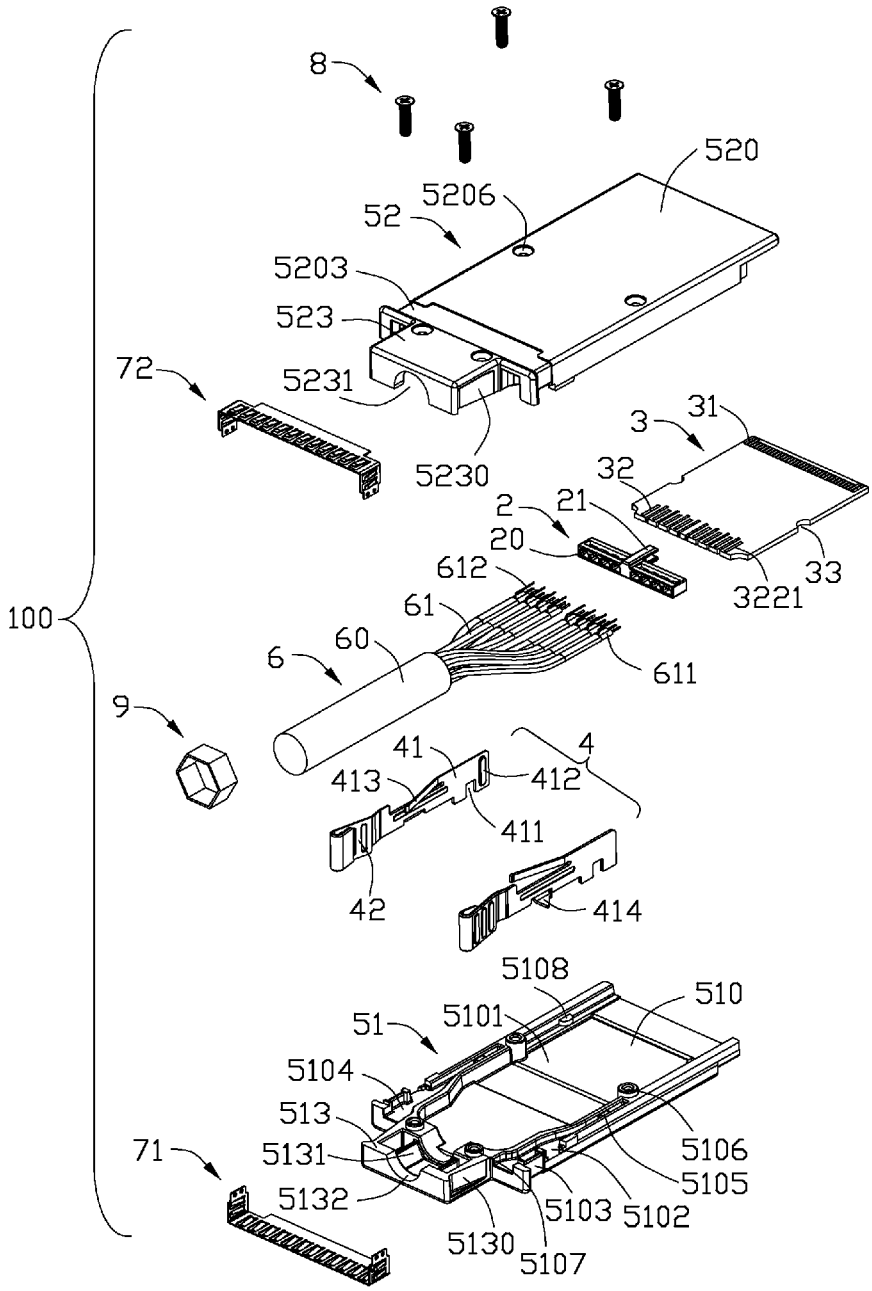
FIG. 3 is another exploded, perspective view of the cable assembly of FIG. 1.
Figure 4:
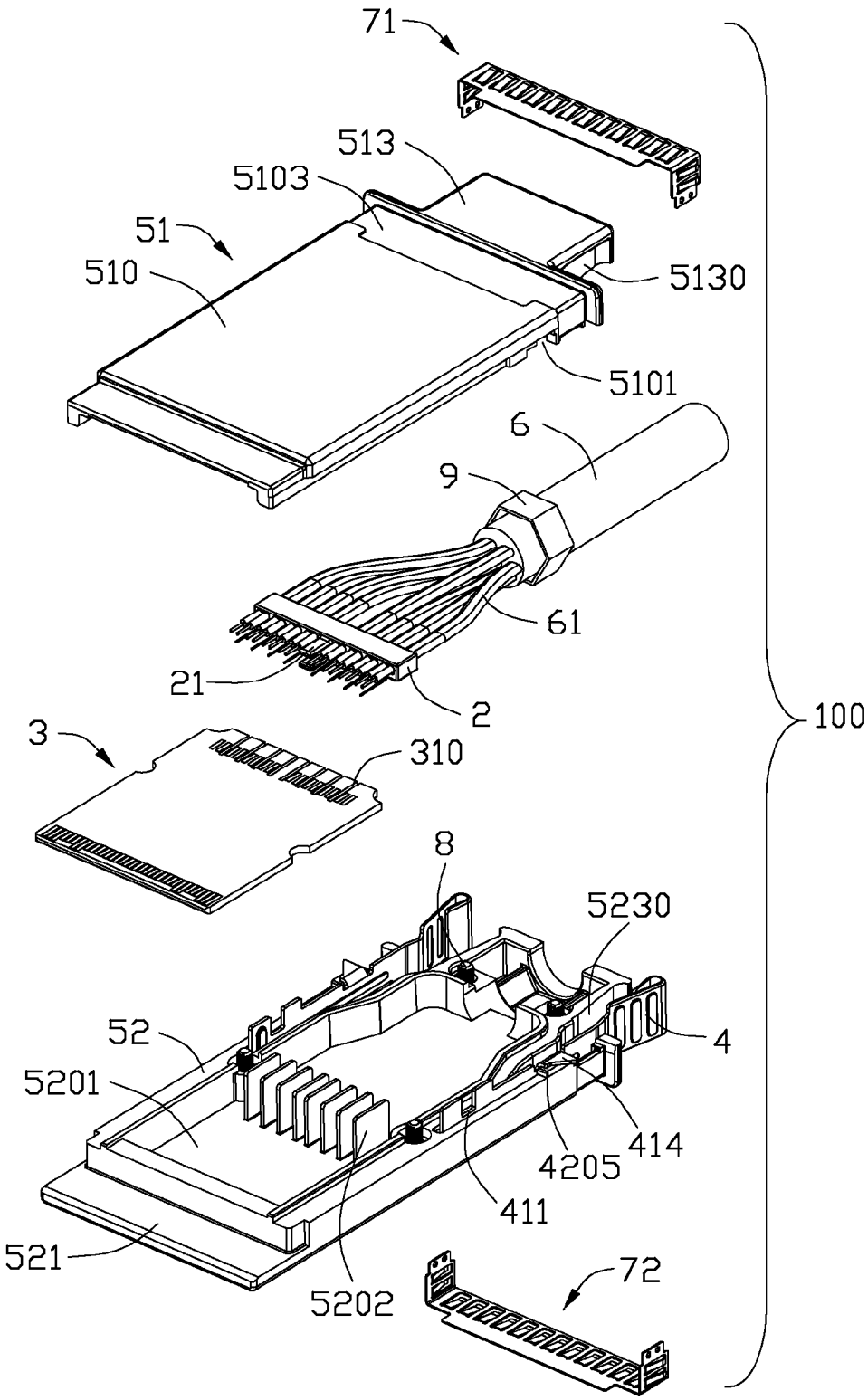
FIG. 4 is a partially assembled, perspective view of the cable assembly of FIG. 1.

Referring to FIGS. 2 to 4, the pair of latches 4 are formed at two sides of the housing 5. A latching mechanism assembled to the housing 5 is formed by pair of the latches 4. Each latch 4 is stamped and formed from a metallic plate and comprises a base portion 41 and a pressing portion 42 extending rearwardly from a rear end of the base portion 41. The base portion 41 defines an inclined elastic portion 413 extending inwardly and rearwardly from an inner side, a latching portion 414 extending outwardly for latching with the complementary connector (not shown), a projection 412 formed on an inner surface thereof, and a gap 411 formed on a top side thereof for receiving the protruding piece 5105 formed in the second channel 5104. In another embodiment, the gap 411 can be also formed on a bottom side thereof for cooperating with a protruding piece formed in the first channel 5204. The pressing portion 42 defines a plurality of projections (not labeled) on an outer surface thereof for ease of operation by a user.

Figure 5:
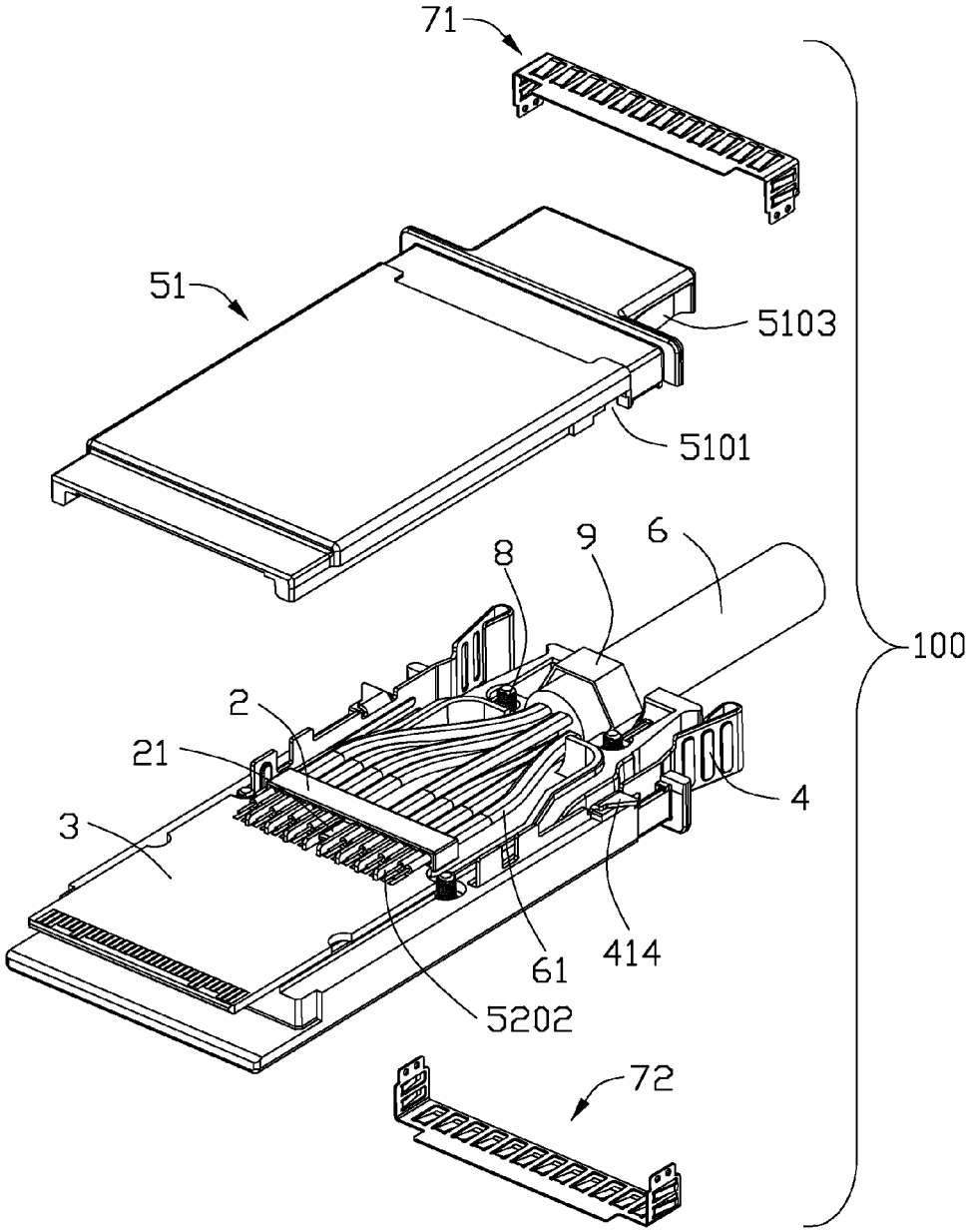
FIG. 5 is another partially assembled, perspective view of the cable assembly of FIG. 1.

Referring to FIGS. 2, 3, and 5, the gasket 7 is a rectangular frame and stamped from a metal sheet. The gasket 7 is used for reducing the electromagnetic interference (EMI) in the signal transmission of the cable assembly 100. The gasket 7 has a first piece 71 and a second piece 72 having a same structure as the first piece 71. The first piece 71 is received into the second depressed area 5103 and engaged with the upper cover 51. The second piece 72 is received into the first depressed area 5203 and engaged with the lower cover 52. The first piece 71 defines a plurality of holes 712 at two sides thereof for cooperating with a plurality of protrusions (not shown) formed in the second depressed area 5103 to achieve an engagement between the first piece 71 and the upper cover 51. The second piece 72 also defines a plurality of holes 722 at two sides thereof for cooperating with a plurality of protrusions (not shown) formed in the first depressed area 5203 to achieve an engagement between the second piece 72 and the lower cover 52. The first and second pieces 71, 72 respectively define a plurality of spring tabs 711, 721. The first and second spring tabs 712, 722 may elastically engage with a conductive panel to which the complementary connector is mounted for grounding and reducing EMI.

Referring to FIGS. 2 to 5, the printed circuit board 3 disposed in the metallic housing 5 defines a mating portion 31 having a plurality of conductive pads 311 thereon and an opposite terminating portion 32 having a plurality of conductive pads 321 for terminating to the cable 6. The conductive pads 311, 321 are respectively arranged on opposite upper and lower surfaces of the mating portion 31 and the terminating portion 32 of the printed circuit board 3 in a transversal direction. The conductive pads 321 are divided into a plurality of first conductive pads 3220 defined on the upper surface of the printed circuit board and second conductive pads 3221 defined on the lower surface of the printed circuit board 3. The printed circuit board 3 defines two positioning holes 33 corresponding to the through holes 5106 and receiving holes 5206 in a vertical direction. The terminating portion of the printed circuit board 3 defines a plurality of slits 320. Each of two adjacent first conductive pads 3220 are spaced apart by a slit 320, and two adjacent second conductive pads 3221 are spaced by a slit 320. When the printed circuit board 3 is assembled to the lower cover 52, each of the plates 5202 of the lower cover 52 vertically extends through the slit 320.

Referring to FIGS. 2 to 3, the cable 6 has a plurality of conductive wires 61 and an insulative layer 60 surrounding the plurality of conductive wires 61. Each of the conductive wires 61 comprises one grounding wire 612 and a pair of differential signal wires 611. The conductive wires 61 are soldered to the terminating portion 31 of the printed circuit board 3. The grounding wire 612 is soldered to the second conductive pad 3221 formed on the lower surface of the printed circuit board 3 and the pair of signal wires 611 are soldered to the first conductive pads 3221 formed on the upper surface of the printed circuit board 3. A strain relief 9 is attached to a front end of the cable 6 and surrounding the insulative layer 60 of the cable 6.

The cable assembly 100 further comprises a rectangular spacer 2. The spacer 2 defines a plurality of passageways 20 spaced apart from each other for the plurality conductive wires 61 of the cable 6 to pass through. The spacer 2 also defines two clamping portion 21 extending forwardly from the middle section of the spacer 2 for engaging to the printed circuit board 3.

Referring to FIGS. 1 to 5, the process of the cable assembly 100 made in according to the present invention comprises following steps. Firstly, the first and second pieces 72, 71 of gasket 7 are assembled to the metallic housing 5. The first piece 71 of gasket 7 is received into the second depressed area 5103 of upper cover 51 and engaged with the upper cover 51. And the second piece 72 of gasket 7 is received into the first depressed area 5203 of the lower cover 21 and engaged with the lower cover 52.

Secondly, the spacer 2 is assembled to the cable 6, with the conductive wires 61 respectively passing through the passageways 20 thereof, and the clamping portion 21 clamping the printed circuit board 3. Then, The conductive wires 61 of the cable 6 are soldered to the terminating portion 32 of the printed circuit board 3 to achieve an electrically and mechanically connection between the printed circuit board 3 and the cable 6. The plurality of signal wires 611 of the cable 6 are soldered to the corresponding first conductive pads 3220. The plurality of grounding wires 612 are soldered to the corresponding second conductive pads 3221.

Thirdly, the printed circuit board 3 and the cable 7 are together assembled to the lower cover 52. The two clamping portion 21 are engaged to the rear portion of the printed circuit board 3. The plates 5202 of the lower cover 52 are respectively passed through the slits 320 of the printed circuit board 3 along a vertical direction. Two adjacent conductive wires 61 are spaced apart with each other by a plate 5202. Two adjacent pairs of signal wires 611 of two conductive wires 61 are also spaced apart with each other the plate 5202. Two adjacent grounding wires 612 are also spaced apart with each other by the plate 5202. The mating portion 31 of the printed circuit board 3 extends forwardly from a front surface of the lower cover 52. The strain relief 9 surrounding the cable 6 is disposed into the first groove 5231. Thus, the cable 6 is preliminary positioned in the lower cover 52.

Fourthly, the pair of latches 4 are respectively received into the pair of second channels 5104 of the upper cover 51. The gap 411 of the latch 4 is cooperated with the protruding piece 5105 formed in the second channel 5104 to make the latch 4 positioned to the upper cover 51 in a front to rear direction. The projection 412 is interferential with an inner surface of the second channel 5104 to make the latch 4 engaged to the upper cover 51. The latching portion 414 of each latch 4 extends laterally to an exterior. The pressing portion 43 extends rewardly out of the second channel 5104 and disposed adjacent to the first rear section 523 of the upper cover 51 in a transversal direction.

Fifthly, the upper cover 51 and the pair of latches 4 are together assembled to the lower cover 52. The bottom surface of the upper cover 51 is attached to the top surface of the lower cover 52 to form the metallic housing 5. The annular ribs 5107 of upper cover 51 are received into the through holes 5206 of the lower cover 52. The pair of protruding portions 5205 of the lover cover 52 are received into the corresponding pair of opening portions 5102 of the upper cover 51. It should be noted that the pair of protruding portions 5205 are not full filled into the pair of opening portions 5102, thus, so a pair of slits (not figured) are formed at two sides of the metallic housing 5 when the lower cover 52 and the upper cover 51 assembled with each other for the latching portions 414 of the pair of latches 4 extending outwardly to an exterior. After the upper cover 51 is assembled to the lower cover 52, the upper cover 51 and the lower cover 52 are positioned with each other in a longitudinal and transversal direction. In addition, the base portion 41 of each latch 4 is received into each first channel 5204 of the lower cover 52. Two pressing portions 42 of the pair of latches 4 are disposed at two sides of the first and second rear sections 523, 513. A top side of the front end of the cable 6 is received into the second semicircular slot 5132 of the upper cover 51. A top side of the strain relief 9 is received into the second groove 5231 of the upper cover 51.

Finally, the four screws 8 are assembled to the lower cover 52 and the upper cover 51 in an up to down direction to interlock the upper cover 51 to the lower cover 52. Each of screw 8 is passed through holes 5206 of the lower cover 52 and received in the receiving holes 5106 of the upper cover 51.

After the above assembling steps, the entire process of assembling the cable assembly 100 is finished. As the lower cover 52 defines a plurality of plates 5202 spaced apart with each other, the plates 5202 of the lower cover 52 are passed through the slits 320 of the printed circuit board 3. Two adjacent grounding wire 612 are spaced apart by the plate 5202, and each two pair of signal wires are also spaced apart by the plate 5202. Due to the protruding plate 5202, the crosstalk between each two pair of signal wires 611 will be reduced when the signal transmitting of the cable assembly 100.

It will be understood that the invention may be embodied in other forms without departing from the spirit or central characteristic thereof. The present examples and embodiments, therefore, are to be considered in all respects as illustrative and not restrictive, and the invention is not to be limited to the details given herein.

What is claimed is:

1. A cable assembly comprising:

a metallic housing defining a receiving room and a plurality of plates in the receiving room;

a printed circuit board received in the receiving room, the printed circuit board defining a front mating portion and a rear terminating portion, the rear terminating portion defining a plurality of slits for the plates to extend through; and a cable comprising a plurality conductive wires electrically connected with the rear terminating portion of the printed circuit board and spaced apart from each other by the plates;

wherein the rear terminating portion has a plurality of first and second conductive pads respectively formed on opposite top and bottom surfaces thereof and arranged along a transversal direction;

wherein each of the conductive wires of the cable defines a pair of signal wires and a grounding wire, the pair of signal wires are soldered to two first conductive pads of the printed circuit board and the grounding wire is soldered to one second conductive pad of the printed circuit board;

wherein a spacer defines a plurality of passageways for the plurality of conductive wires to pass through and having two clamping portions extending thereof engaging with the rear terminating portion of the printed circuit board; and wherein a gasket has spring tabs surrounding the metallic housing.

2. The cable assembly as claimed in claim 1, wherein two adjacent grounding wires are spaced apart by the protruding plate, and two adjacent pairs of signal wires are also spaced apart by the protruding plate.

3. The cable assembly as claimed in claim 1, wherein the metallic housing defines a base portion, a tongue portion extending forwardly from the body portion, and a rear portion extending rearwardly from the body portion, the tongue portion is parallel with the mating portion of the printed circuit board.

4. The cable assembly as claimed in claim 1, further comprising a pair of latches formed at two sides of the metallic housing.

5. The cable assembly as claimed in claim 1, further comprising a plurality of screws, and wherein the metallic housing comprises an upper cover and a lower cover fastened together by the screws.

6. A cable assembly comprising:

a conductive housing including a lower conductive cover and an upper conductive cover and a plurality of plates disposed therein;

a printed circuit board sandwiched between the lower and upper covers, the plurality of plates being perpendicular to the printed circuit and extending through a plurality of slits formed at a rear end of the printed circuit board; and a cable comprising a plurality of conductive wires arranged along a transversal direction and electrically connected to the rear end of the printed circuit board, two adjacent conductive wires being spaced apart from each other by an associated plate;

wherein each of the conductive wires of the cable comprises a pair of signal wires and one grounding wire, the plurality of signal wires being electrically connected to a to surface of the rear end of the printed circuit board, the plurality of grounding wires being electrically connected to a bottom surface of the rear end of the printed circuit board;

wherein a wire spacer attaches to a front end of the cable and having two clamping portion extending therefrom engaging to the rear end of the printed circuit board; and wherein a gasket has spring tabs surrounding the housing.

7. The cable assembly as claimed in claim 6, wherein the two grounding wires of two adjacent conductive wires are spaced apart by the protruding plate, and the two pairs of signal wires of two adjacent conductive wires are also spaced apart by the protruding plate.

8. The cable assembly as claimed in claim 6, further comprising a pair of latches assembled to two sides of the housing.

9. A cable connector assembly for use with a complementary connector, comprising:

a housing defining a receiving room;

a printed circuit board retained in the receiving room and defining on two opposite surfaces and along a front-to-back direction a front coupling region for and a rear soldering region defining a plurality of differential circuit pad pairs thereof;

a plurality of slits formed in the rear soldering region between every adjacent two differential circuit pad pairs, respectively, in a transverse direction perpendicular to said front-to-back direction;

a plurality of metallic plates snugly inserted into the corresponding slits and extending above both said two opposite surfaces in a vertical direction perpendicular to both said front-to-back direction and said transverse direction; and a plurality of differential pair wires defining corresponding inner conductors soldered unto the corresponding differential circuit pad pairs, respectively;

wherein said metallic plates separate the neighboring differential circuit pad pairs and the corresponding differential pair wires, respectively, in said transverse direction;

wherein a spacer locates behind the printed circuit board, through which said differential pair wires extend; and wherein the spacer is equipped with a pair of clamping portions sandwiching the rear soldering region of the printed circuit board therebetween.

10. The cable connector assembly as claimed in claim 9, wherein each of said differential pair wires is further equipped with a drain wire mechanically and electrically connected to the metallic plate beside.

11. The cable connector assembly as claimed in claim 10, wherein said housing is metallic, and said metallic plates are unitarily formed on an interior of the housing.

* * * * *